United States Patent [19]

Castarède

[11] 4,223,647

[45] Sep. 23, 1980

[54] SLANTED INTERNAL COMBUSTION ENGINE

[75] Inventor: Armand Castarède, Meudon la Forêt, France

[73] Assignee: Regie Nationale des Usines Renault, Boulogne-Billancourt, France

[21] Appl. No.: 947,319

[22] Filed: Oct. 2, 1978

[30] Foreign Application Priority Data

Oct. 5, 1977 [FR] France ..... 77 30011

[51] Int. Cl.³ ..... F02L 1/26

[52] U.S. Cl. ..... 123/59 A; 123/84; 123/657

[58] Field of Search ..... 123/191 R, 191 M, 59 R, 123/59 A, 188 M, 84

[56] References Cited

U.S. PATENT DOCUMENTS

| | | | |
|---|---|---|---|
| 2,094,893 | 10/1937 | Jacoby | 123/59 A |
| 2,669,227 | 2/1954 | Drinkard | 123/191 M |
| 2,763,254 | 9/1956 | Klug | 123/191 M |
| 2,767,694 | 10/1956 | Boghossian | 123/191 M |
| 3,276,438 | 10/1966 | Keinath | 123/59 A |

FOREIGN PATENT DOCUMENTS

| | | | |
|---|---|---|---|
| 558779 | 1/1944 | United Kingdom | 123/191 M |

*Primary Examiner*—Charles J. Myhre
*Assistant Examiner*—Craig R. Feinberg
*Attorney, Agent, or Firm*—Beveridge, DeGrandi, Kline & Lunsford

[57] ABSTRACT

Each cylinder of a slanted, in-line, overhead valve, internal combustion engine has intake and exhaust valves with axes which extend radially from and perpendicular to the camshaft axis. The camshaft axis is above an inclined plane which includes the central axes of the cylinders, and the valve axes are mutually divergent to intersect this plane at different angles.

5 Claims, 3 Drawing Figures

SLANTED INTERNAL COMBUSTION ENGINE

BACKGROUND AND SUMMARY

This invention relates to a slanted internal combustion engine of the type wherein several in-line cylinders are inclined with respect to the vertical, and an overhead camshaft actuates an intake valve and an exhaust valve for each cylinder. Intake and exhaust passages are situated on the same side of the cylinder head.

In existing slant engines, the axes of the intake and exhaust valves of each cylinder are parallel, both valve axes lying perpendicular to the axis of the camshaft in order to ensure a correct direct drive of the valves. The belief has been that both valve axes should be located in the same plane passing through the camshaft axis, in order to facilitate the machining of the valve-receiving cylinder head.

On a slanted engine, the accepted arrangement of coplanar intake and exhaust valve axes presents a number of problems having to do in particular with the dimensioning of the valve-actuating elements, the accessibility of the engine components when repairs or adjustments are to be carried out, the steps of feeding and combustion, and the engine's performance in general.

The object of the present invention is to provide a configuration which will eliminate these disadvantages and make it possible to give the engine, in its entirety, a strong slant or inclination with respect to the vertical in order to obtain a propulsive group with minimal height.

In the engine of the invention, the axes of the intake valve and the exhaust valve of each cylinder lie in planes parallel to each other and perpendicular to the axis of the camshaft, and these valve axes diverge from each other as they approach their respective cylinder. Accordingly, the intake valve axis and the exhaust valve axis have different inclinations. This provides greater freedom in selecting the diameters of the valve heads in accordance with criteria which provide good feeding and good combustion, without necessitating other measures such as longitudinal redimensioning of the camshaft.

The axis of the camshaft is located above the inclined plane which includes the cylinder axes, making it possible to give the intake passages in the cylinder head a non-countersloped shape, in spite of the obstacle created by the seating of the springs of the valves, even when the engine is sharply inclined.

In an advantageous embodiment of the invention, the axis of the intake valve is inclined with respect to the common plane occupied by the plural cylinder axes, the intake valve axis crossing the cylinder axis plane midway between the axis of the camshaft and the valve head. In the same way, it is advantageous for the axis of the exhaust valve to be inclined with respect to the common plane of the cylinder axes in such a way that the exhaust valve axis crosses the cylinder axis plane approximately on a level with the head of the exhaust valve. Such an arrangement makes it possible to make the intake and exhaust passages flow into the combustion chamber and to position the spark plug in that chamber for optimum feeding and combustion.

Other characteristics and advantages of the invention will be apparent from reading the following explanatory and nonlimiting description of an embodiment of the engine of the invention.

THE DRAWINGS

THE PREFERRED EMBODIMENT

The invention applies to an internal combustion engine with several in-line cylinders, each of which has an intake valve and an exhaust valve driven directly by a cam on a single overhead camshaft. The axis 1 of each cylinder 2 is sharply slanted or inclined with respect to the vertical, this inclination being about 60° in the illustrated example. Such engines are commonly referred to as "slant" or "slanted" engines.

Figure 1:
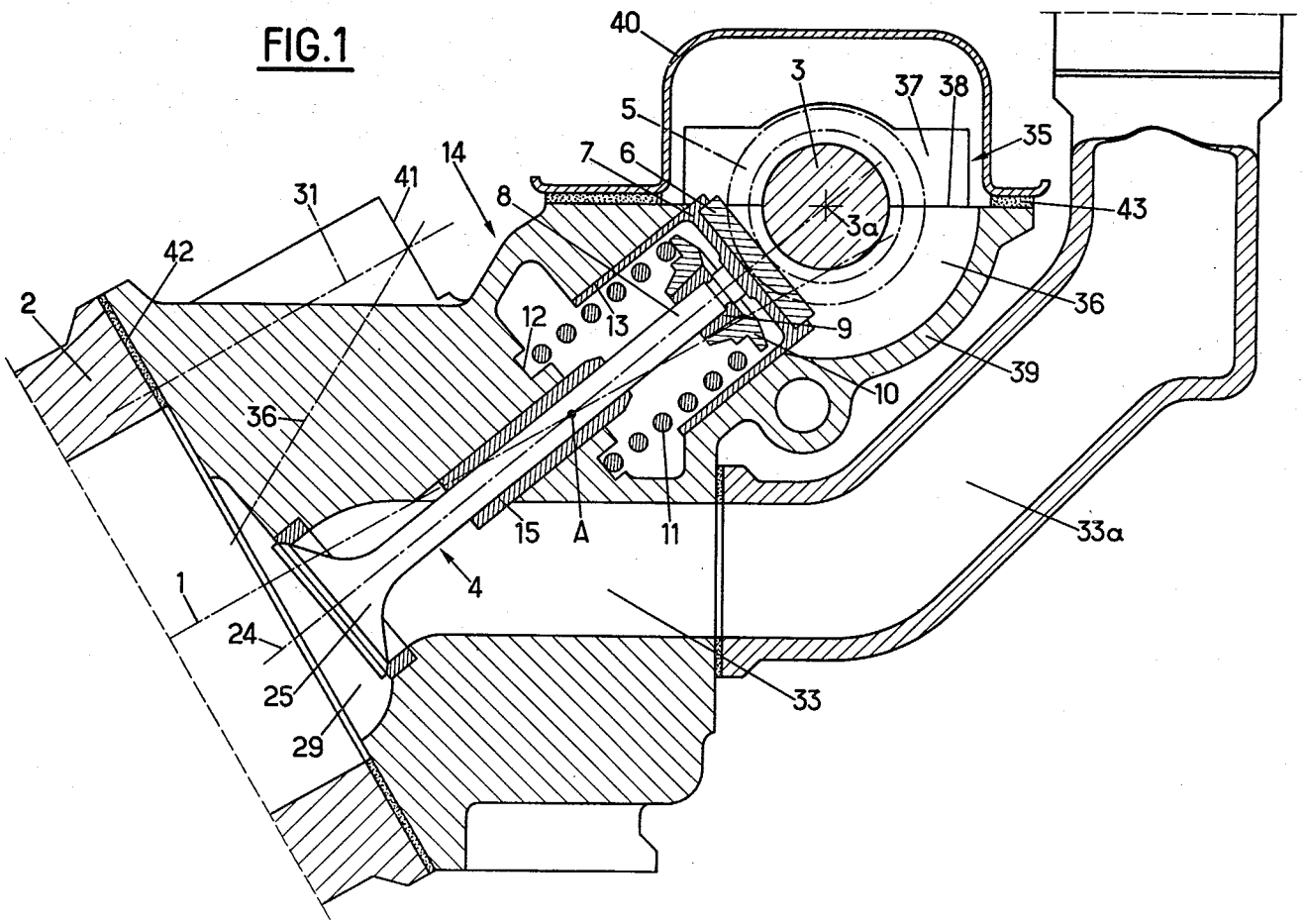
FIG. 1 is a transverse section of the engine, in the plane of an intake valve.

In FIG. 1, the camshaft 3 rotates about its axis 3*a* to control the intake valve 4 by a conventional lobe-shaped cam 5, minimum and maximum radii of which are represented by interrupted lines. Cam 5 acts upon the plate 6 of a push rod 7 to which the stem 8 of the intake valve 4 is attached in a conventional manner, passing through two semicones 9 and a cup 10. The cup 10 serves as a support for one end of a spring 11 whose opposite end rests against the bottom of a groove 12 provided in the bottom of a cylindrical recess 13 in the cylinder head 14. The recess 13 serves as a guide for the push rod 7. The intake valve 4 slides in a guide 15 fixed in the cylinder head 14.

Figure 2:
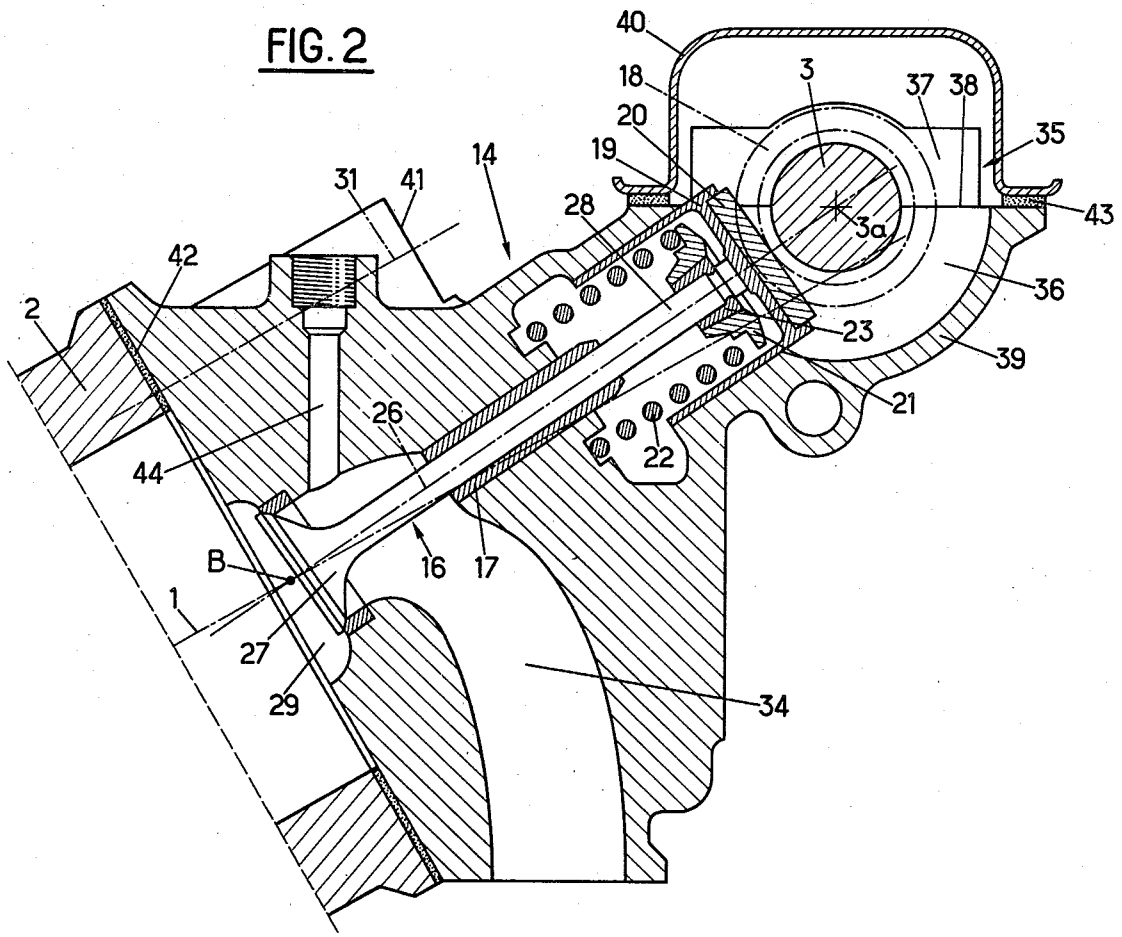
FIG. 2 is a transverse section similar to FIG. 1 but taken in the plane of the exhaust valve of the same cylinder.

In the same way, in accordance with FIG. 2, the exhaust valve 14 slides in a guide 17 fixed in the cylinder head 14 and is moved by a cam 18 of the shaft 3. The exhaust valve assembly also includes a push rod 19 with a plate 20, a cup 21 for a spring 22 and two semicones 23.

It will be noted in FIG. 1 that the axis 24 of the intake valve 4 intersects the axis 3*a* of the camshaft 3 and lies in a plane which is perpendicular to the camshaft axis 3*a*. Axis 24 is inclined with respect to the axis 1 of the cylinder 2 in such a way that the axis 24 intersects the plane containing the cylinder axes 1 at a point A which is located between the valve head 25 and the push rod end of valve stem 8, i.e. between the valve head 25 and the camshaft axis 3*a*.

The exhaust valve 16 shown in FIG. 2 has an axis 26 intersecting the camshaft axis 3*a* and lying in a plane which is perpendicular to the camshaft axis 3*a*. Thus, valve axes 24 and 26 lie in parallel planes. Exhaust valve axis 26 has a different inclination than the intake valve axis, causing these axes to diverge from each other as they approach the cylinder. Axis 26 is inclined with respect to the axis 1 of the cylinder 2 in such a way that the exhaust valve head 27 is approximately centered on the cylinder axis 1. The exhaust valve axis 26 actually intersects the plane containing the cylinder axes 1 at a point B which is located slightly beyond the valve head 27 in the illustrated closed position.

The result of this particular arrangement is that the camshaft axis 3*a* is situated above the common plane of the axes 1 of the cylinders 2. Furthermore, it will be noted that, in this embodiment, the intake valve 4 is more inclined than the exhaust valve 16 with respect to the common plane of the axes 1.

Figure 3:
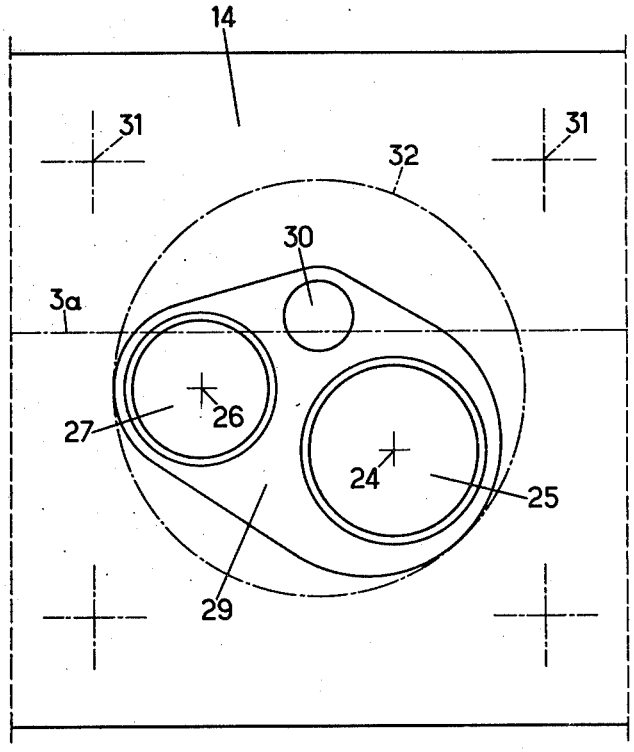
FIG. 3 is a view of the bottom of the cylinder head, taken parallel to the cylinder axis.

FIG. 3 depicts the recessed bottom of the cylinder head 14, showing the intake valve head 25, exhaust valve head 27 and a threaded spark plug hole 30. The hole 30 for the spark plug enters the central area of the combustion chamber between the valve heads 25 and 27. It can be seen in FIG. 3 that the head 27 and axis 26 of the exhaust valve 16 are closer to the projection of camshaft axis 3*a* than the head 25 and axis 24 of the intake valve. In FIG. 3, the axes 26 and 24 are shown in the mating plane of the cylinder 2 and cylinder head 14; and, the camshaft axis 3*a* is shown projected in a direction parallel to the parallel cylinder axes 1. The spark plug hole 30 is placed in the immediate proximity of the projection of camshaft axis 3*a*. The distance, measured in the plane of FIG. 3, of the projection of the valve axes 24 and 26 on the camshaft axis 3*a* is smaller than such distance would be if the axes 24 and 26 were not inclined relative to the cylinder axis 1. The head bolts holding the cylinder head on the cylinder, locates on axes 31, are arranged symmetrically, very close to the projection 32 of the cylinder bore.

The intake passage 33 shown in FIG. 1, and the exhaust passage 24 shown in FIG. 2, open outwardly to the lower portions of the cylinder head 14. The spark plug, whose axis 36 is shown in FIG. 1, is installed from the upper face of the cylinder head 14. The intake passage 33, connected by a manifold conduit 33*a* to a carburetor (not shown) which is located above the camshaft 3, makes a greater obtuse angle with the axis 24 of the intake valve 4 than if the valve were parallel to the cylinder axis 1, which facilitates filling of the cylinder bore. The passage 33 and conduit 33*a* do not have any counterslope which would be detrimental to feeding.

One also sees, in FIGS. 1 and 2, that the bearings 35 of the camshaft 3 include a lower part 36 on the cylinder head 14 and a separate cap 37, with the mating plane 38 of the bearing parts 36 and 37 being horizontal. The camshaft 3 is mounted in a camshaft housing which includes a lower, recessed part 39, cast integrally with the cylinder head 14, and a removable cover 40. The mating plane of cover 40 and part 39 coincides with the plane 38 of the bearings 35. For some angles of an engine inclination, it may prove necessary to incline slightly the mating plane 38 of the bearing and camshaft housing in order to facilitate the installation and removal of the push rods.

The plane 38 includes the camshaft axis 3*a* and is located where axial access, unobstructed by the cast cylinder head 14, is provided for the tools which spot face the bosses 41 for the head bolts on axes 31. The distances between the head bolts may be minimized by this arrangement. The plane 38 is also located where the installation and removal of the push rods 7 and 19 is unobstructed, except by the camshaft 3. On the lower side of the cylinder head, i.e. on the side of the intake and exhaust pipes 33, 34, access along the lower axes 31 for the spot facing tools is unobstructed by the cylinder head casting 14 to permit a symmetrical distribution of the head bolts on axes 31 as shown in FIG. 3. This is possible because part 39 of the cylinder head is located as close as possible to the camshaft 3, and the camshaft axis 3*a* is displaced above the cylinder axis 1 of the previously-described valve location.

There are a number of advantages which may be realized from the use of this invention.

The disclosed arrangement permits a minimum spacing between the head bolts on axes 31, and assists in establishing a secure cylinder-head joint 42. It also facilitates adjustment of the clearances between the push rods and the cams because of the convenient accessibility of these elements from the upper face of the cylinder head.

This structure further makes it possible to establish an oil bath in the camshaft housing without immersing the gasket 43 of the camshaft cover 40. The gasket 43 is located above the liquid level of the oil bath.

Further, as shown in FIG. 2, the invention makes it possible to locate an air-injection connector 44 on the upper face of the cylinder head 14, opening into the exhaust passage 34, for injecting air into the exhaust for afterburning purposes, for example.

The valve assembly is itself improved by adoption of this invention. The inclination of the valve axes with respect to each other makes the distance between the intake and exhaust valves at the push rods smaller than it is at the valve heads, thereby reducing the risk of overheating for a given cylinder bore diameter, and permitting a better dimensioning of the valves. The same is true of the dimensioning of the camshaft bearings, since the distance between the intake and exhaust cams may be reduced in favor of longer camshaft bearings. Thus, the camshaft can have bearings with a smaller diameter, so that its housing and cover interfere even less with tool and manual accessibility for machining, and anchoring the cylinder head, changing the spark plugs and making various adjustments.

Regardless of the angle of engine inclination, the cylinder head may be formed as a compact unit including the intake passages, without deterring from the intake flow to the combustion chamber.

The application of the arrangement of the invention to an automobile engine enables one to slant it down as near the horizontal as possible, which permits a dropped hood line, in despite of the presence of a carburetor with an air filter on top of it. It has been found that such a large inclination of a four-cylinder, in-line engine in current use, makes it possible to reduce the vertical components of the exciting forces of the second order which propagate noise through the engine mounts. Also, accessories such as the spare wheel may be fitted in the engine compartment without difficulty.

The combustion and performance of the engine are improved by the central position of the spark plug and the opening of the intake pipe into the cylinder, with the filling being facilitated by the improved angle which the intake valve forms with the intake pipe.

The spark plug, cooled by the intake flow, is easy to install and to reach because the intake and exhaust passages are both situated on the opposite side of the cylinder head from the spark plug.

The distances between the head bolts holding the cylinder head in position are reduced to a minimal value compatible with the diameter of the cylinder bore, but access to the head bolts is not hampered thereby. The cylinder head can be tightened without removing the camshaft housing cover.

The clearances between the push rods and the cams can be adjusted easily since the push rods and the camshafts are exposed when the cover of the camshaft housing is removed.

The fact that the intake and exhaust passages flow from the same side of the cylinder head may permit the use of a one-piece manifold in which the intake conduits would be preheated by the exhaust gases.

The large amount of height available under the hood line because of the reduced height of the slanted engine makes it possible to increase the length of the intake conduit, thus making sure of good vaporization of the air-fuel mixture before it enters the combustion chamber. This arrangement also makes it possible to place an air filter with a large cross section on the carburetor and to install auxiliary feed-improving systems under the carburetor for preventing vapor lock, preventing icing etc.

Of course a number of modifications and variations may be made without departing from the spirit of the present invention as recited in the following claims.

I claim:

1. An internal combustion engine, comprising a plurality of in-line cylinders having axes which lie in a common plane which is sharply inclined with respect to the vertical, a cylinder head having an exposed lower surface spaced from said cylinders, said head having for each cylinder an intake passage and an exhaust passage, said intake and exhaust passages leading outwardly from the cylinders to the exposed lower surface of the cylinder head, a single overhead camshaft parallel to said common plane of the cylinder axes, said camshaft having a rotational axis which is offset above the said common plane of the cylinder axes, an intake valve and an exhaust valve for controlling said intake and exhaust passages of each cylinder, said valves being directly actuated along their respective axes by said camshaft, said valves lying in mutually parallel planes which are perpendicular to said camshaft axis, said valves of each cylinder diverging from each other as they approach their cylinder and intersecting the common plane of the cylinder axes at different angles, the axes of said inlet valves being more sharply inclined with respect to said common plane than the axes of said exhaust valves inclined with respect to said common plane.

2. The internal combustion engine of claim 1, wherein the axes of the exhaust valves intersect said common plane of the cylinder axes substantially at the heads of the exhaust valves.

3. The internal combustion engine of claim 1 or claim 2, wherein the axes of the inlet valves intersect said common plane of the cylinder axes substantially midway between the camshaft axis and the head of the inlet valves.

4. The internal combustion engine of claim 1 or claim 2 wherein both the inlet and exhaust valves have heads, the projections of which, along the cylinder axis, on the cylinder is contained within the cylinder bore, the cylinder head including a spark plug opening which opens outwardly to the upper exposed portions of the cylinder head and inwardly within said cylinder substantially at the center of the combustion chamber between the heads of the inlet valve and the exhaust valve.

5. The internal combustion engine of claim 1 or claim 2, wherein said cylinder head comprises a camshaft housing including a lower recessed part integral with the cylinder head and a removable cover, and camshaft bearings including removable upper caps and lower parts integral with the cylinder head, said camshaft housing and said bearings having mating planes which are horizontal and coincidental with each other.

* * * * *